US006176277B1

(12) United States Patent
Mayer

(10) Patent No.: US 6,176,277 B1
(45) Date of Patent: Jan. 23, 2001

(54) DEVICE FOR FILLING A PRESSURIZED PHARMACEUTICAL FLUID INTO PACKAGING CONTAINERS

(75) Inventor: Werner Mayer, Wallhausen (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/405,108

(22) Filed: Sep. 27, 1999

(30) Foreign Application Priority Data

Sep. 25, 1998 (DE) ..... 198 44 011

(51) Int. Cl.[7] ..... B65B 1/20; B65B 1/28; B65B 3/18; B65B 3/22

(52) U.S. Cl. ..... 141/82; 141/100; 141/102; 141/234; 141/236; 141/242; 141/244; 222/54; 222/61; 222/146.6

(58) Field of Search ..... 141/82, 100, 102, 141/234–237, 242, 244; 222/54, 61, 146.6, 394, 396, 399

(56) References Cited

U.S. PATENT DOCUMENTS 4,216,879 8/1980 McMillin ..... 222/1
5,701,937 * 12/1997 Bourboulou et al. ..... 141/244
5,823,234 * 10/1998 Boertz ..... 141/67
5,871,121 * 2/1999 Hashimoto et al. ..... 222/54

FOREIGN PATENT DOCUMENTS 43 41 934 A1 6/1995 (DE) ..... 141/83

* cited by examiner

*Primary Examiner*—Henry J. Recla
*Assistant Examiner*—Timothy L. Maust
(74) *Attorney, Agent, or Firm*—Ronald E. Greigg; Edwin E. Greigg

(57) ABSTRACT

A device for filling a pharmaceutical fluid into vials has a product container, which is connected to a distributor by way of a first line. Filling lines branch from the distributor and have filling valves for the individual vials. In order to improve the filling precision, particularly with fluids that have a very temperature-dependent flow behavior, the invention discloses cooling the distributor via a coolant so that during the filling procedures, the fluid has a substantially constant temperature. That substantially constant temperature then forms the basis underlying the calculation of the triggering time of the filling valves by a control unit with greater precision than is shown in the prior art.

11 Claims, 1 Drawing Sheet

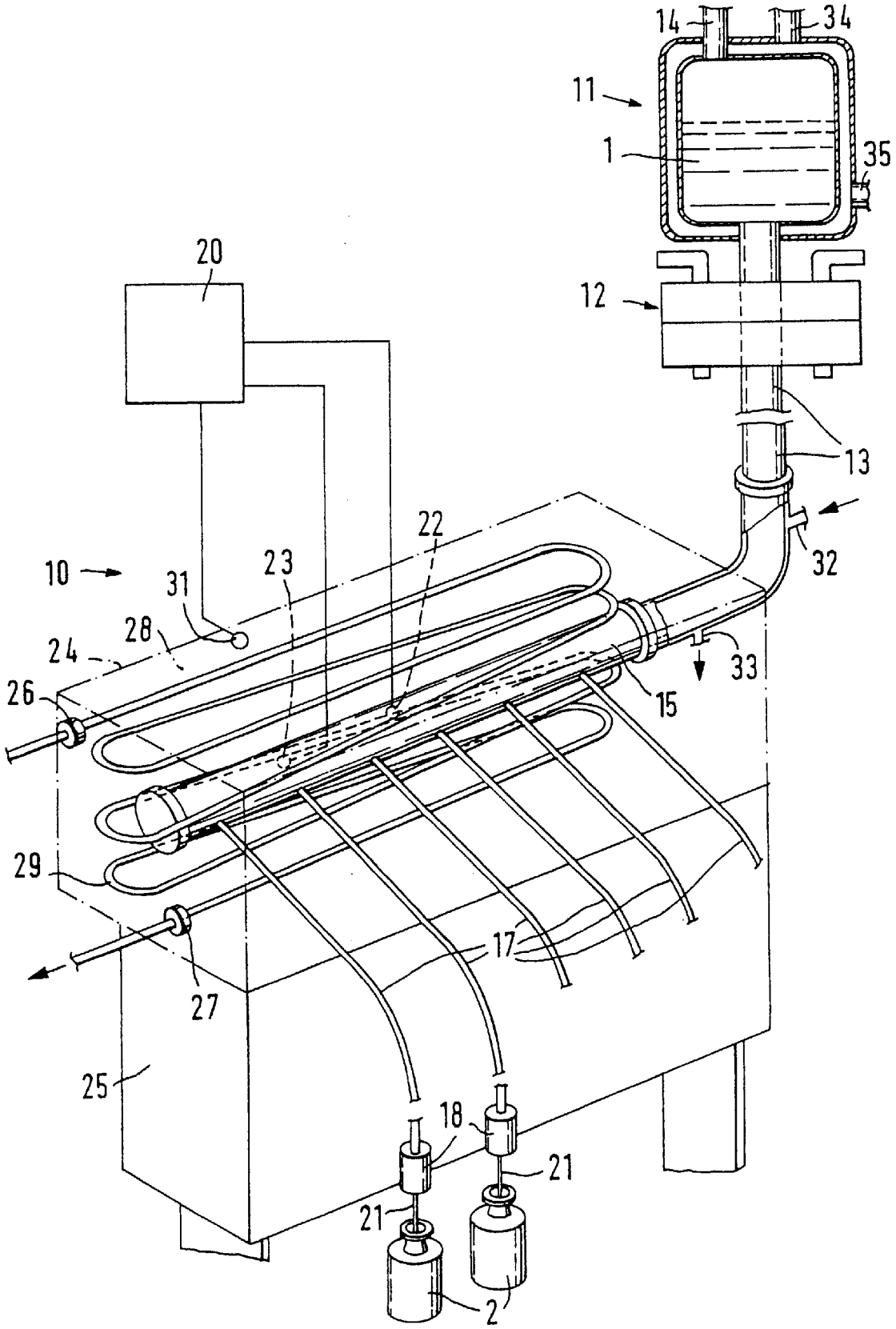
14
34
11
1
35
20
12
13
22
10
23
31
32
28
24
33
26
15
29
17
27
25
18
21
21
2

DEVICE FOR FILLING A PRESSURIZED PHARMACEUTICAL FLUID INTO PACKAGING CONTAINERS

FIELD OF THE INVENTION

The invention discloses improvements in a device for filling a pressurized pharmaceutical fluid into packaging containers.

BACKGROUND OF THE INVENTION

In a known device of this type, disclosed in German published patent application DE 43 41 934 A1, provision is made to calculate the filling time for the fluid, if need be, by taking into account the temperature detected by a temperature sensor disposed in the distributor. However, it has been learned by experience with devices of this type that the measurement of the fluid temperature, and the adaptation of the filling time by means of software programs that take the fluid temperature into account, does not produce satisfactory results with regard to filling precision. This drawback is particularly the case with products that have a very temperature-dependent flow behavior.

OBJECTS OF THE INVENTION

It is a principal object of the disclosed device for filling a pressurized pharmaceutical fluid into packaging containers that the filling precision is very high even when the flow behavior of the fluid to be filled is very temperature-dependent. This object is achieved by virtue of the fact that according to the invention, the fluid is supplied to the filling valves at a certain, particularly constant temperature. In this way the otherwise discernible temperature fluctuations of the fluid can be prevented, which fluctuations are produced as a result of the components of the filling device warming up—for example, during a batch change, after a production pause, or at the start of the filling.

Other advantages and advantageous improvements of the device according to the invention for filling a pressurized pharmaceutical fluid into packaging containers will become apparent from a review of the drawings taken in condjuction with the specification.

BRIEF DESCRIPTION OF THE DRAWING

An exemplary embodiment of the invention is depicted in the drawing and will be explained in detail below. The sole figure is a schematic representation of a part of a device for filling a pressurized pharmaceutical fluid into packaging containers.

Description of the Exemplary Embodiment

The device 10 shown in FIG. 1 is used for filling a pressurized pharmaceutical fluid 1 into packaging containers such as vials 2, ampules, or the like. To this end, the device 10 has a product container 11, which can be interchangeably fastened to a supply line 13 by means of a rapid clamping device 12. In order to apply an overpressure to the fluid 1, a connection 14 is also provided on the product container 11 and is connected to a pressure source that is not shown.

In the filling region, the supply line 13 feeds into a tubular distributor 15 from which the filling lines 17 branch, which lead directly to the individual vials 2. A filling valve 18 is disposed at the end of each filling line 17 and can be triggered by the control unit 20 of the device 10. The ends of the filling lines 17 oriented toward the vials 2, which ends are embodied as filling needles 21, are disposed so that they can move up and down in the customary fashion in order to be able protrude into the top openings of vials 2, which are supplied cyclically by means of a feed device, during a stopping phase of the vials 2. The devices required for this are not shown because they are known in and of themselves and are not essential to the invention.

The opening time of the filling valves 18, which is essential with regard to the precise filling quantity, is calculated by the control unit 20 by means of taking into account the pressure detected by a pressure sensor 22 that is disposed in the distributor 15 and connected to the control unit 20. Furthermore, a first temperature sensor 23 is provided, if need be, in the distributor 15 and is likewise connected to the control unit 20.

The device 10 is particularly equipped to prevent incorrect meterings of the fluid 1 due to temperature fluctuations of the fluid 1 that manifest themselves in an altered viscosity. The basic concept of the invention is that during the filling, i.e. when passing through the filling valves 18, the fluid 1 should always have a quite definite temperature whose consequently known viscosity is taken into account by the control unit 20 when calculating the opening times of the filling valves 18.

To that end, the distributor 15 and a section of the filling lines 17 are integrated into a block-shaped housing 24, which for its part is disposed on a bracket 25 of the device 10. The housing 24 has an inlet fitting 2G and an outlet fitting 27 for a coolant which is conveyed through the housing 24.

In the exemplary embodiment shown, the housing 24 is embodied as a hollow housing, whose inner chamber 28 has a cooling line 29 passing through it, which is routed in loops. The cooling line 29 encompasses the distributor 15 in the housing 24 so that the distributor 15 is cooled by means of convection.

The temperature prevailing in the housing 24 can be detected by means of a second temperature sensor 31, which is coupled to a temperature regulating circuit in order to keep the temperature in the housing constant.

In order to produce an additional cooling of the fluid 1 before it enters the distributor 15, at least a part of the supply line 13 is additionally embodied as double-walled with an inlet 32 and an outlet 33 for coolant. Furthermore, the product container 11 can also be embodied as double-walled with an inlet 34 and an outlet 35 in order to permit coolant to flow through.

As mentioned above, the basic concept of the invention is comprised in filling the pharmaceutical fluid 1 with as constant a temperature as possible, in this instance, the coolant-generated temperature of the fluid 1. This temperature, which is monitored by means of the second temperature sensor 31 disposed in the housing 24, is kept constant by means of the above-mentioned temperature regulating circuit. The goal is to cool the fluid 1 in the distributor 15 down to a quite definite temperature whose viscosity forms the basis underlying the calculation of the opening time of the filling valves 18 by the control unit 20 and to keep this temperature as constant as possible during the filling procedures.

Whether the supply line 13 and the product container 11 must also be cooled in addition to the distributor 15 depends on a number of factors. The volume of the distributor 15 in relation to the number of filling lines 17, the filling volume to be output into the vials 2 during each filling procedure, and the set temperature of the fluid 1 are particularly decisive in this connection. The faster the fluid volume disposed in the distributor 15 is replenished with new fluid 1 from the supply line 13 and the product container 11 and the lower the temperature of the fluid 1 in the distributor 15 in relation to the fluid temperature in the supply line 13 and the product container 11, the more necessary it is to also cool the supply line 13 and product container 11. Furthermore, it must be taken into account that at a higher temperature, the fluid 1 is more susceptible to germ growth so that there is the basic tendency to cool the entire product volume and therefore the entire device 10.

The choice of the temperature, which forms the basis underlying the calculation of the filling time and the design of the cooling circuit, is strongly dependent on the type of fluid 1. It should also be noted that many pharmaceutical products should be filled while cold in order to extend their shelf lives. Although the concept of the invention is based solely on keeping the fluid temperature constant at the filling valves 18, so that it could also be quite conceivable not to cool the fluid 1 to a particular temperature but to heat it, for the above-mentioned reason, a reduction in the temperature in relation to the ambient temperature is selected for most pharmaceutical fluids 1.

Particularly with longer periods of machine inactivity, for product safety reasons regarding the above-mentioned perishable fluids 1, in addition to a cooling of the distributor 15, which would otherwise suffice, a cooling of the product paths, i.e. the supply line 13 and the product tank 11, must be taken into account.

It should also be mentioned that the filling precision of the device 10 can be further increased if the software of the control unit 20 is in a position to adapt the opening time of the filling valves 18 in the event of slight temperature fluctuations of the fluid 1 in the distributor 15 which are detected by the first temperature sensor 23. To this end, corresponding temperature/viscosity characteristics of the fluid 1 are stored in the control unit 20. Since the temperature fluctuations of the fluid 1 are reduced in comparison to devices which have no means for keeping the temperature of the fluid 1 constant, the fluctuations in the filling times are similarly less than in conventional devices.

Furthermore, it has been assumed in the exemplary embodiment that the temperature of the fluid 1 remains virtually unchanged on its way from the distributor 15 or the housing 24 to the filling valves 18. If the specific conditions of the device 10 or the surroundings do not assure this, then the sections of the filling lines 17 protruding beyond the housing 24 and also, if need be, the filling valves 18 should be cooled.

I claim:

1. A device (10) for filling a pressurized pharmaceutical fluid (1) into individual packaging containers such as ampules, and vials (2), having a first line (13) that supplies the pressurized fluid (1) from a product container (11) to a distributor (15), further having filling lines (17) that branch from the distributor (15) and lead to the individual packaging containers, said filling lines are provided with filling valves (18), a pressure sensor (22) for the pressurized fluid (1) being disposed in the distributor (15) and connected to a control unit (20) for calculation of triggering times of the filling valves (18), and first means includes a housing (24) that at least partially encloses the distributor (15), said housing having an inner chamber (28) containing at least one cooling line (29) connected to a coolant circuit and encompassing the distributor (15).

2. The device according to claim 1, in which third means are provided for keeping the temperature in the product container (11) constant, said third means including a double-walled product container (11) that has a second inlet (34) and a second outlet (35) and has coolant flowing through it.

3. The device according to claim 1, in which second means are provided for keeping the temperature constant in at least one partial section of the first line (13).

4. The device according to claim 3, in which the second means includes a double-walled first line (13) that has a first inlet (32) and a first outlet (33) and has coolant flowing through it.

5. The device according to claim 3, in which third means are provided for keeping the temperature in the product container (11) constant, said third means including a double-walled product container (11) that has a second inlet (34) and a second outlet (35) and has coolant flowing through it.

6. The device according to claim 4, in which third means are provided for keeping the temperature in the product container (11) constant, said third means including a double-walled product container (11) that has a second inlet (34) and a second outlet (35) and has coolant flowing through it.

7. A device (10) for filling a pressurized pharmaceutical fluid (1) into individual packaging containers such as ampules, and vials (2), having a first line (13) that supplies the pressurized fluid (1) from a product container (11) to a distributor (15), further having filling lines (17) that branch from the distributor (15) and lead to the individual packaging containers, said filling lines are provided with filling valves (18), a pressure sensor (22) for the pressurized fluid (1) being disposed in the distributor (15) and connected to a control unit (20) for calculation of triggering times of the filling valves (18), and first means includes a housing (24) that at least partially encloses the distributor (15), said housing has an inner chamber (28) containing at least one coolant conduit.

8. The device according to claim 7, in which second means are provided for keeping the temperature constant in at least one partial section of the first line (13).

9. The device according to claim 8, in which the second means includes a double-walled first line (13) that has a first inlet (32) and a first outlet (33) and has coolant flowing through it.

10. The device according to claim 8, in which third means are provided for keeping the temperature in the product container (11) constant, said third means including a double-walled product container (11) that has a second inlet (34) and a second outlet (35) and has coolant flowing through it.

11. The device according to claim 2, in which third means are provided for keeping the temperature in the product container (11) constant, said third means including a double-walled product container (11) that has a second inlet (34) and a second outlet (35) and has coolant flowing through it.

* * * * *